US007906715B2

(12) United States Patent
Coco et al.

(10) Patent No.: US 7,906,715 B2
(45) Date of Patent: Mar. 15, 2011

(54) PULLER FOR GUITAR BRIDGE PINS OR THE LIKE

(76) Inventors: John Coco, Elmont, NY (US); Daniel L. Roeper, Garden City, NY (US)

( * ) Notice: Subject to any disclaimer, the term of this patent is extended or adjusted under 35 U.S.C. 154(b) by 179 days.

(21) Appl. No.: 12/156,690

(22) Filed: Jun. 3, 2008

(65) Prior Publication Data

US 2008/0302230 A1 Dec. 11, 2008

Related U.S. Application Data

(60) Provisional application No. 60/933,445, filed on Jun. 5, 2007.

(51) Int. Cl.
*G10D 3/04* (2006.01)

(52) U.S. Cl. ..... 84/307

(58) Field of Classification Search ..... 84/307, 84/327, 312 R
See application file for complete search history.

(56) References Cited

U.S. PATENT DOCUMENTS 4,997,163 A 3/1991 Henning
D386,373 S 11/1997 Weinmuller
6,066,143 A 5/2000 Lane
6,793,200 B2 9/2004 Bystrom
2007/0193430 A1* 8/2007 Jang ..... 84/313

* cited by examiner

*Primary Examiner* — Kimberly R Lockett

(74) *Attorney, Agent, or Firm* — Abelman, Frayne & Schwab

(57) ABSTRACT

A compact tool for removing guitar bridge pins is disclosed, which includes a housing and an active swing arm having a metal capture notch at the free end for receiving the head of the pin requiring removal. The tool is preferably made of machined steel, and the capture notch has a three-sided configuration with a lip which is configured and dimensioned to be easily positioned beneath the head of the pin, while the head of the pin sites within a recessed cavity adjacent the lip. The user conveniently grips the housing to apply the requisite force to remove the pin from the bridge of the guitar. While the three-sided lip is preferably made of a strong metal such as steel, hardened aluminum, zinc or the like, other materials are contemplated, provided they are strong and durable. Alternatively, the tool can be constructed in a T-Shaped configuration, incapable of folding. Still alternatively, the tool can be fabricated as a single straight one-piece device incorporating the unique three sided capture notch of the invention.

19 Claims, 6 Drawing Sheets

PULLER FOR GUITAR BRIDGE PINS OR THE LIKE

CROSS REFERENCE TO RELATED APPLICATIONS

This application claims the benefit of U.S. Provisional Application No. 60/933,445, filed Jun. 5, 2007, the disclosure of which is incorporated by reference herein and made a part of this application.

BACKGROUND OF THE INVENTION

1. Field of the Invention

The present invention relates generally to a puller for guitar bridge pins or the like. More specifically, the invention relates to a compact pocket tool for removing guitar bridge pins to change the strings, without causing damage to the portion of the guitar adjacent the pins.

2. Description of the Related Art

It can be appreciated that guitar bridge pin pullers have been in use for years. Typically a guitar bridge pin puller is comprised of a pin puller that is positioned beneath the head of the bridge pin and uses a prying motion to remove the pin. This type of puller is often provided in the form of a rounded notch in the end portion of a guitar tuning peg winder.

Another type of known pin puller does not use the same prying motion, but instead pulls the pin straight up. However, this device is generally made of plastic, and includes two opposed claw-like teeth which are respectively positioned beneath the head of the pin for application of a pulling force. With this device, the tool can slip off the head of the pin, or slide out of position while it is being pulled.

The main problem with the first mentioned type conventional guitar bridge pin pullers is that the prying motion will often damage the bridge of the guitar. For example, the bridge is often made of soft wood such as rosewood, and removing a bridge pin with the traditional lever-type pin remover will leave small indentations in the wood. Another problem with conventional guitar bridge pin pullers such as the second type mentioned hereinabove, is that since all of these pin pullers are generally made of plastic, the pin pulling capture notch often flexes under strain, causing the tool to pop off of the pin without removing it. Furthermore, the relatively weak plastic pin pulling capture notch often wears out over time, rendering the tool useless after repeated use. Still another problem with existing upward pulling-type pin pullers is that they are open at both ends, which allows the pin to easily slip out of the tool. This action can inadvertently cause the user to damage the face of the guitar. Additionally, such existing tools are almost always connected to a tuning peg winder as a combination tool. In such arrangement, the tool needs to swivel in order to wind the pegs. The swiveling motion sometimes makes it difficult to use the tool for pin pulling due to the movement of the tool head.

While these devices may be suitable on a limited basis for the particular purposes for which they are intended, they are not as suitable for removing guitar bridge pins in order to change the strings. As noted, the main problem with conventional guitar bridge pin pullers is that the prying motion will often damage the bridge of the guitar. The bridge is often made of a soft wood such as rosewood and removing a bridge pin with the traditional lever type pin remover will leave small indentations in the wood.

Another problem is that since all of these pin pullers are made of plastic, the pin pulling capture notch often flexes under strain, causing the tool to loose its grip and slip off the pin without removing it. This problem is underscored by the fact that the capture notch generally only includes two gripping teeth, spaced about 180 degrees apart. With this type of structure, the pin pulling capture notch often wears out over time.

After repeated uses the plastic notch can wear away, rendering the tool useless. The present invention departs substantially from the conventional concepts and designs of the prior art, and in so doing, provides a compact apparatus primarily developed for the purpose of removing guitar bridge pins in order to change the strings.

In view of the foregoing disadvantages inherent in the known types of guitar bridge pin puller now present in the prior art, the present invention provides a new construction wherein the same can be utilized for removing guitar pins in order to change the strings.

SUMMARY OF THE INVENTION

The general purposes of the present invention, which will be described subsequently in greater detail, is to provide a new puller for guitar bridge pins of the like that has many of the advantages over presently known guitar bridge pin pullers heretofore and many novel features that result in a new bridge pin puller which is not anticipated, rendered obvious, suggested, or even implied by any of the known guitar bridge pin pullers, either alone or in any combination.

To attain this objective, the present invention generally comprises a main body and swing arm with a capture notch at the free end. The main body serves as a housing for the swing arm. It also has a flange or lip having an aperture machined into it where a keychain ring can be attached. The swing arm is machined so that a major portion fits into the groove which is machined into the main body, with the exception of the capture notch. The capture notch sits next to the main body when in the closed position, forming a compact, generally cylindrical shape. The capture notch has a lip that extends over three sides—or about 270 degrees—and that is machined to fit under the head of a guitar's bridge pin to remove it. Furthermore, the capture notch is preferably made of a strong durable metal, and has a recessed cavity where the head of a bridge pin sits during removal. Other materials are contemplated, such as durable and hard plastics, etc., such as for example, Dupont's Delrin® brand plastics, glass filled nylon, or high density molecular weight polyethylene.

A standalone ergonomic puller for removing a bridge pin from a guitar bridge is disclosed, which comprises a handle configured and dimensioned to accommodate a hand crush grip with thumb resting on index finger, and an extension member attached to the handle and having a capture notch at a free end thereof. The extension member includes a recessed cavity directly adjacent to the capture notch, the recessed cavity being configured and dimensioned to receive and engage the undersurface of the bridge pin head in a manner to facilitate application of direct force thereto to remove the bridge pin from the guitar bridge.

The capture notch of the ergonomic puller is dimensioned and configured to snugly surround the stem of the bridge pin so as to engage the undersurface of the bridge pin head. The capture notch extends approximately 270 degrees around the inner perimeter of the free end to fit under the head of the bridge pin for optimal engagement therewith. The capture notch is formed with a beveled undersurface to promote substantial purchase with the undersurface of the bridge pin head to prevent slippage of the puller with respect to the bridge pin.

The extension member is pivotably movable between a first closed position in-line with the handle, and a second open position generally perpendicular to the handle having an over-center position, and in a manner such that when the handle is positioned adjacent the guitar bridge in a generally parallel relation thereto, the extension member is in a generally perpendicular relationship to the guitar bridge.

The handle is formed as a housing with a groove to receive the swing arm when in the closed position such that at least a portion of the swing arm fits in the groove to form a generally ergonomically cylindrical shaped puller.

The capture notch is made of a material selected from one of metal, hard plastic, glass filled nylon, high density molecular weight polyethylene and other hard materials.

The recessed cavity is dimensioned and configured to accommodate commercially available bridge pins, each bridge pin having a size distinct from other bridge pins.

In one embodiment, the extension member is fixedly oriented in a generally perpendicular relationship to the handle in a non-collapsible monolithic structure.

It should be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary feature of the present invention is to provide a puller for guitar bridge pins that will overcome the shortcomings of the prior art devices.

Another feature of the present invention is to provide an improved collapsible and compact pocket device for removing guitar bridge pins in order to change the strings.

Another feature is to provide a strong and durable pin puller for guitar bridge pins that can remove guitar bridge pins without prying on the bridge of the guitar and without causing surface damage to the adjacent areas.

Still another feature is to provide a puller for guitar bridge pins that is small, lightweight and easy to carry.

Still another feature of the invention relates to a puller for guitar bridge pins that is not connected to a tuning peg winder, and that can be used with a majority of bridge pins. Furthermore, the present device will never wear out from repeated uses.

A method of using the ergonomic puller for removing a bridge pin from a guitar bridge is also disclosed.

Other objects, features and advantages of the present invention will become obvious to the reader, and it is intended that these objects, features and advantages are within the scope of the present invention.

To the accomplishment of the above and related objects, features and advantages, the present invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Preferred embodiments of the invention will be described hereinbelow with reference to the drawings, wherein.

DETAILED DESCRIPTION OF THE INVENTION

Figure 1:
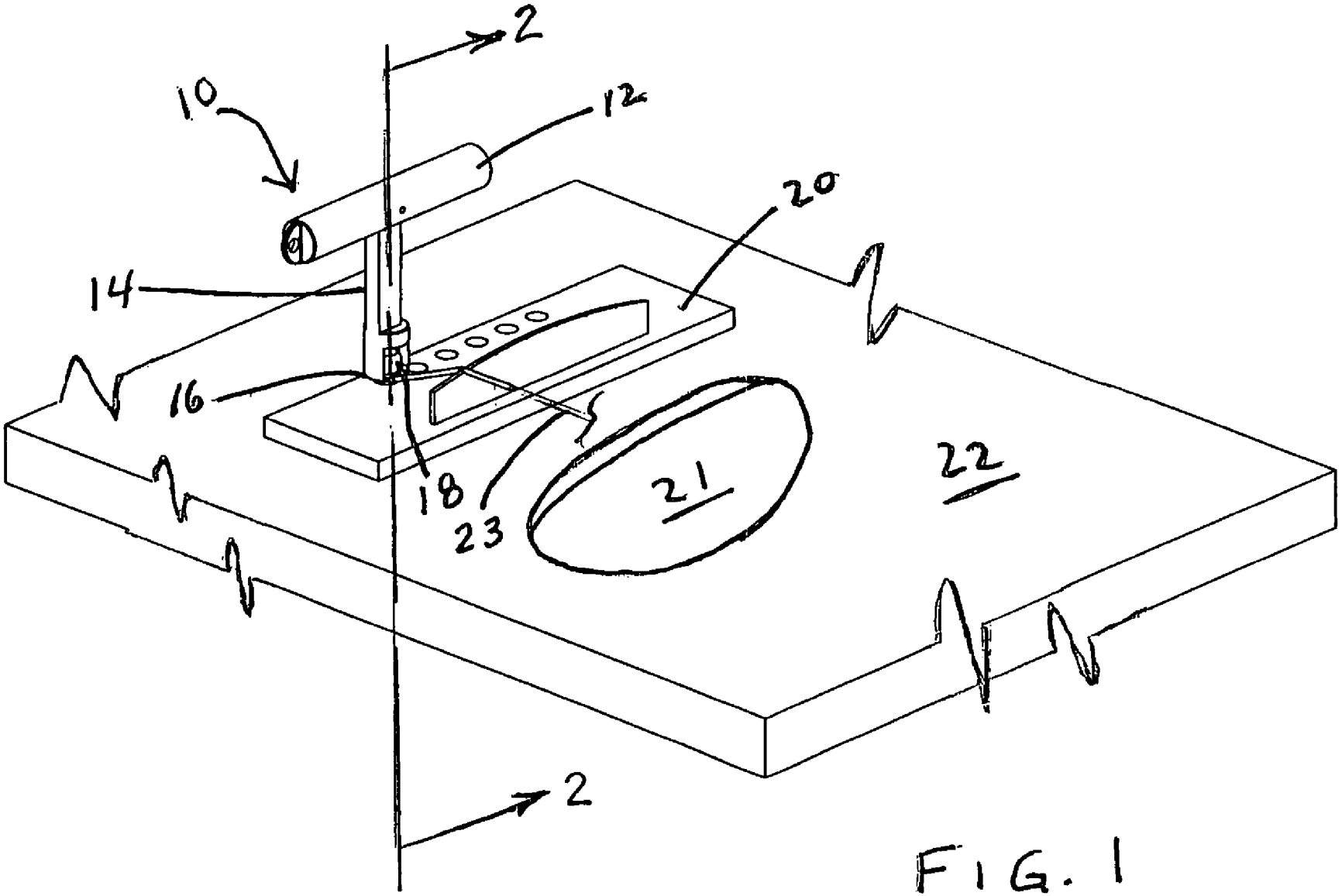
FIG. 1 is a left side perspective view from above, of a guitar bridge mounted on a sound-board of an acoustic guitar, illustrating the removal of a bridge pin from the guitar with the tool of the present invention, for the purpose of changing a string.
Figure 2:
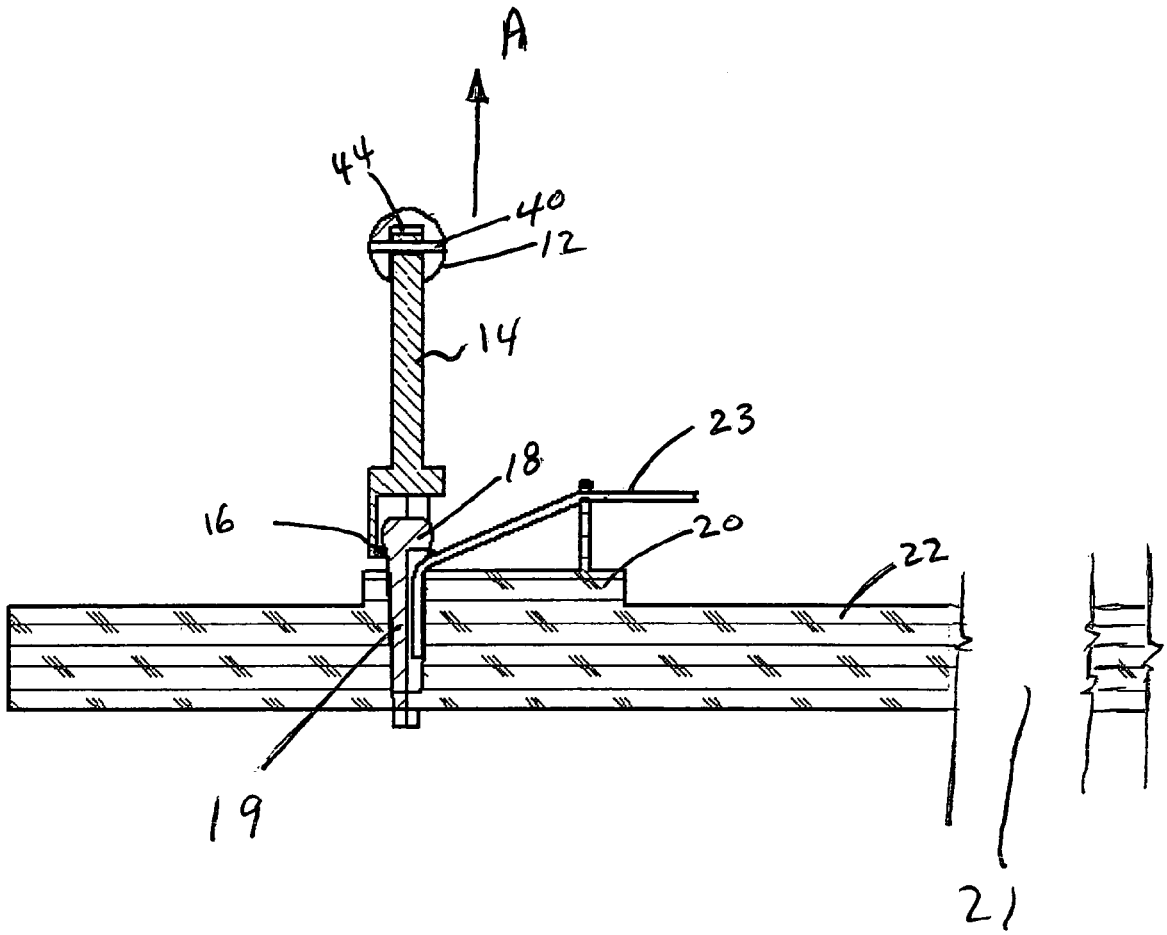
FIG. 2 is a cross-sectional view, taken along line 2-2 of FIG. 1.

Turning now to the drawings, in which similar reference characters denote similar elements throughout the several views, the attached Figs. illustrate a standalone ergonomic pin puller 10 for guitar bridge pins constructed according to the invention. Referring initially to FIGS. 1 and 2, the pin puller 10 comprises a main body 12 and an extension member (swing arm) 14 with capture notch 16 to remove a bridge pin 19 from bridge 20 mounted on sound-board 22 of an acoustic guitar to change string 23. Essentially the capture notch is an arcuately shaped end piece defining a semi-circular notch which surrounds and "captures" a major circumferential portion of the pin just below the head in order to obtain substantial purchase under the surface of the head (i.e., preferably 270 degrees) for pulling the pin from its cavity.

The entire guitar is not shown in FIG. 1, but rather only sound-board 22 with sound opening 21 are shown. The main body 12 of pin puller 10 serves the dual function as a housing for the swing arm 14, and as a gripping device for applying force to the bridge pin 19 via the swing arm 14.

Figure 3:
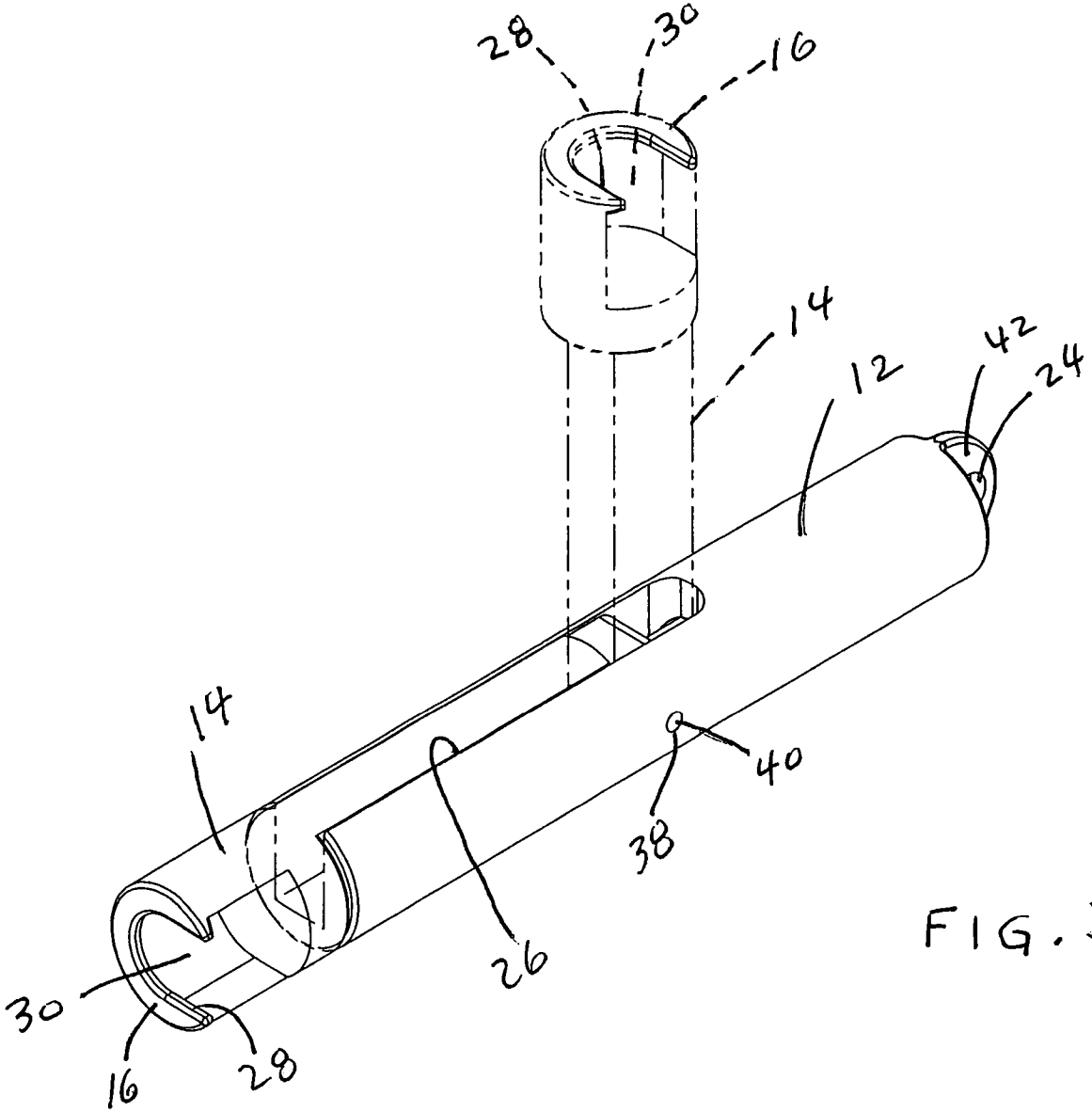
FIG. 3 is a right side perspective view from above, of the hand tool shown in FIGS. 1 and 2 for removing guitar pins, constructed according to the present invention, and showing the active swing arm in phantom lines in the open—or pin removal—position.
Figure 4:
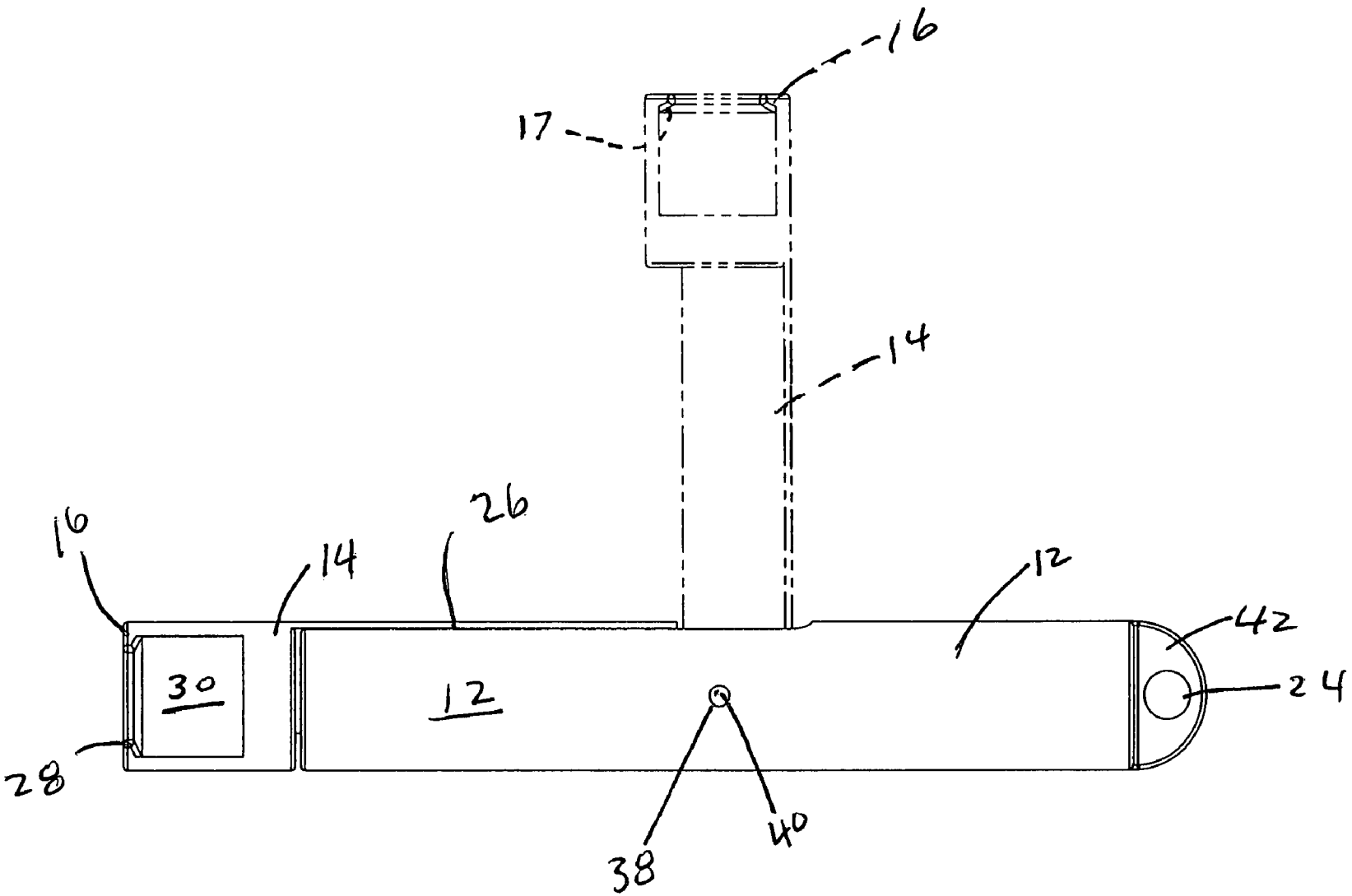
FIG. 4 is a side elevational view of the hand tool of FIGS. 1 and 2, illustrating in phantom lines, the active swing arm in the pin removal position.

As can be seen in FIG. 3, main body 12 includes a flange 42 at one end, which has an aperture 24 machined into it for attachment to a keychain ring. The swing arm 14 is machined so that the majority of it fits into groove 26 which is machined into the main body 12, with the exception of the capture notch 16. As best seen in FIG. 3, the capture notch 16 sits next to the main body 12 when in the closed position, forming a compact cylindrical shape. The capture notch 16 has a lip 28 that is essentially three-sided, and which is machined to fit snugly under the head 18 of a guitar bridge pin 19 to remove the pin for re-stringing or other purposes, as best shown in FIGS. 1 and 2. As seen in FIG. 4, the undersurface 17 of the capture notch is beveled (i.e., chamfered) to promote optimal surface-to-surface contact between the capture notch and the lower surface (i.e., bottom) of the head of the pin which is usually spherical or near spherical. As can be seen in the drawings, the capture notch 16 achieves substantial purchase with the underside of the head 18 of the pin 19, gripping about 270 degrees of the undersurface of the head. The capture notch 16 is preferably made of a strong metal such as steel, hardened aluminum, zinc or the like, for reasons of strength, and it has a recessed cavity 30 where the head of a bridge pin sits during removal. Other materials can be used, provided they are strong and durable and able to withstand the pulling forces applied to remove such pins. As noted previously, such materials as Delrin® brand plastics, glass filled nylon, or high density molecular weight polyethylene are contemplated.

Figure 5:
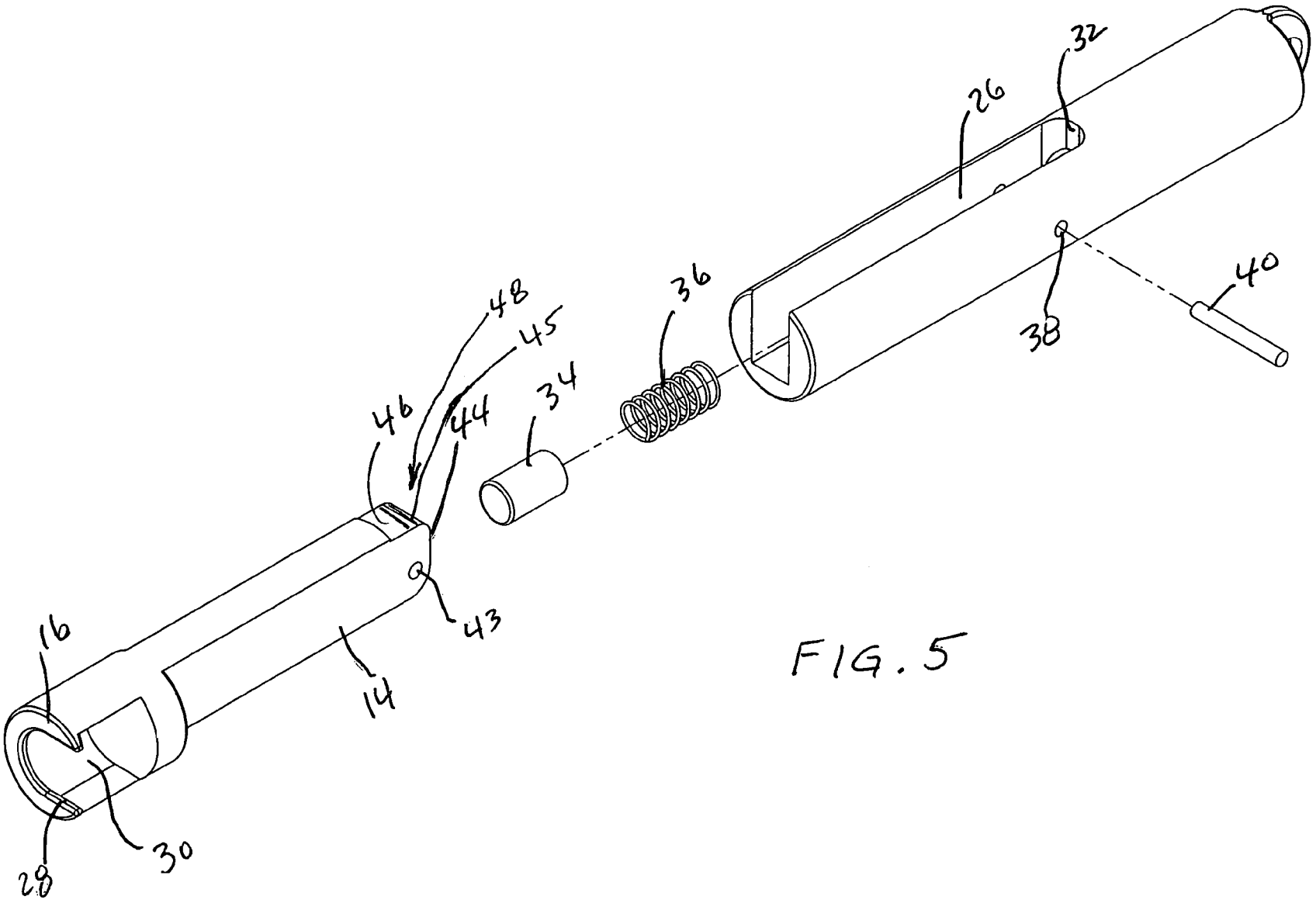
FIG. 5 is a right side perspective view of the hand tool of the present invention, with parts separated to illustrate the camming motion of the swing arm in the open and closed positions.

As can be seen in the Figs., the main body 12 serves as a housing for the swing arm 14. Preferably, the main body 12 is a one-piece machined chrome plated steel cylinder with a rectangular notch 26 that runs little more than half way through the length thereof to accommodate the swing arm 14 when in the stored position. Inside the notch 26 of the main body 12, there is a small spring cavity 32 where a cam 34 and a coil spring 36 sit to keep the swing arm 14 in the desired position, i.e. either in the folded, or the open—or active—position. Housing 12 also has a hole 38 drilled through the midsection as shown in FIG. 5, where a small pivot pin 40 is inserted to provide a hinge for the swing arm 14 via pivot aperture 43 located at the pivot end of the swing arm 14. In addition, there is a semi-circular flange or protrusion 42 on the end of housing 12 opposite the swing arm 14 with an aperture 24 drilled into it in order to accommodate a key ring.

As can be seen in the Figs., the main body 12 is the housing for all of the other components. The main body can be various sizes, shapes and finishes. Various hinge placement and applications can be used to create the same desired effect. Optionally, the key ring protrusion can be removed to provide a sleeker design. Also, the capture notch 26 for the swing arm 14 can be made in various shapes to accommodate other swing arm shapes, dimensions and configurations, or even alternative types of pins.

Figure 6:
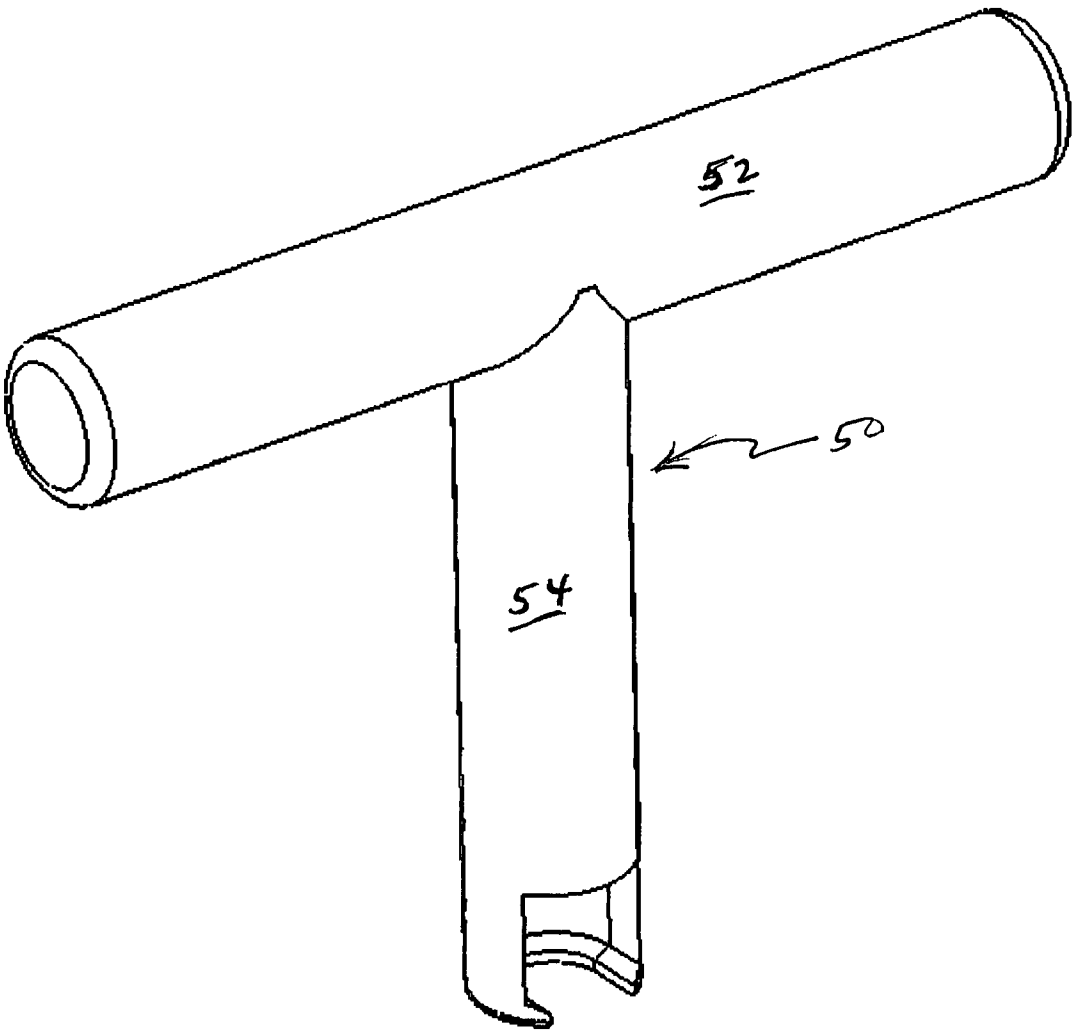
FIG. 6 is a perspective view of an alternative embodiment of the invention, wherein the puller is structured according to a fixed "T" shaped configuration, incapable of collapsing as in the first embodiment.

One variation of this pin puller is shown in FIG. 6. In this alternative embodiment, the puller 50 is structured and designed to eliminate all moving parts and is fabricated as a fixed "T" shaped tool incapable of the collapse function of the previous embodiment. The main body 52 and the functional pulling arm 54 are essentially the same shape, but the arm 54 would permanently be in the open position. In another variation (not shown) the main body and pulling arm 14 are in the form of a single straight piece, with the same unique three-sided capture notch 16 at the free end. This would provide a pen shaped tool which could be easily carried with other small implements. Essentially this alternative embodiment would appear like the tool shown in FIG. 3 where in the closed condition, but structured as a single piece.

The tool which is illustrated in FIGS. 1-5 has two positions, open and closed. In the closed position, the swing arm 14 is held in place by the spring 36 and steel cam 34 in the recessed spring cavity 32 of the main body 12. As can best be seen in FIG. 5, the spring 36 engages the cam 34 against the butt end 44 of the swing arm 14, which keeps the swing arm 14 aligned with the main body 12 when in the folded condition, thereby creating a unique compact cylindrical configuration. The swing arm 14 can then be manually moved to the open position shown in FIGS. 1 and 3, in which it forms a 90 degree angle with the main body 12. The spring 36 and cam 34 again hold the swing arm in the open position by pushing up against the butt side (camming surface) 46 of the swing arm 14 as shown in FIG. 5. When the tool is moved from the open position to the closed position, the spring 36 is compressed within the recessed spring cavity 32, which is configured and dimensioned to allow the cam 34 to provide room for the swing arm 14 to change positions. To open or close the swing arm 14, a user simply exerts force on the swing arm 14 in the appropriate direction. At this point, the cam 34, impelled by the spring 36, exerts force against a curved portion 45 of the cam surface 48 and the swing arm is deflected to the other position, passing through an over-center position therebetween. For example, in the open position, the user can grip the tool by inserting it between the index and middle fingers in a hand crush grip with the thumb resting on the index finger. The capture notch 16 is then slid under the head 18 of the bridge pin 19 as shown for example in FIGS. 1 and 2, until the head sits just above the three-sided cavity of the capture notch 16 and within the recessed cavity 30 adjacent the capture notch 16. The user then exerts upward force on the bridge pin in the direction of arrow "A" in FIG. 2, which pulls the pin from its tapered hole in which it is generally held by friction or press fit, or a combination of both. Generally a force of between 15 and 20 pounds is required to remove most pins. Accordingly, it can be appreciated that the configuration of the tool and its related structure is critical to successful and quick removal of a bridge pin without damaging the guitar.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and descried in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An ergonomic puller for removing a bridge pin from a guitar bridge, which comprises:

a) a handle configured and dimensioned to accommodate a hand grip; and b) an extension member attached to said handle and having a capture notch at a free end thereof, said capture notch being made of a material selected from one of metal, hard plastic, glass filled nylon, high density molecular weight polyethylene and other hard materials, said extension member including a recessed cavity directly adjacent said capture notch, said recessed cavity being configured and dimensioned to receive and engage the undersurface of the bridge pin head in a manner to facilitate application of direct force thereto to remove the bridge pin from the guitar bridge.

2. The ergonomic puller according to claim 1, wherein the bridge pin is comprised of a stem having a head at one end thereof, and said capture notch is dimensioned and configured to snugly surround the stem of the bridge pin so as to engage the undersurface of the bridge pin head.

3. The ergonomic puller according to claim 2, wherein said capture notch extends approximately 270 degrees around the inner perimeter of said free end to fit under the head of the bridge pin for optimal engagement therewith.

4. The ergonomic puller according to claim 3, wherein said capture notch is formed with a beveled undersurface to promote substantial purchase with the undersurface of the bridge pin head to prevent slippage of the puller with respect to the bridge pin.

5. The ergonomic puller according to claim 4, wherein said extension member is of such dimension to avoid prying on the guitar bridge or causing surface damage to the adjacent areas or other guitar bridge pins when pulling a particular bridge pin.

6. The ergonomic puller according to claim 5, wherein said extension member is movable between a first closed position in-line with said handle, and a second open position generally perpendicular to said handle in a manner such that when said handle is positioned adjacent the guitar bridge in a generally parallel relation thereto, said extension member is in a generally perpendicular relationship to the guitar bridge.

7. The ergonomic puller according to claim 6, wherein said extension member is pivotably attached to said handle with a pivot pin inserted through related aligned apertures.

8. The ergonomic puller according to claim 7, wherein said handle is formed as a housing with a groove to receive said extension member when in said closed position such that at least a portion of said extension member fits in said groove to form a generally ergonomic cylindrically shaped puller.

9. The ergonomic puller according to claim 8, wherein:

a) said handle further defines a cavity;

b) a coil spring positioned within said cavity; and c) a cam member positioned between said coil spring and said extension member, wherein said coil spring alternatively compresses and extends under a load and causes said cam member to engage said extension member to facilitate locking said spring arm in one of said first closed position and said second open position, said extension member passing through an over-center position therebetween.

10. The ergonomic puller according to claim 1, wherein said recessed cavity is dimensioned and configured to accommodate commercially available bridge pins, each bridge pin having a size distinct from other bridge pins.

11. The ergonomic puller according to claim 1, wherein said extension member is fixedly oriented in a generally perpendicular relationship to said handle in a non-collapsible structure.

12. The ergonomic puller according to claim 1, wherein said extension member is oriented in a generally perpendicular relationship to said handle in a non-collapsible monolithic fixed structure, such that when said handle is positioned adjacent the guitar bridge in generally parallel relation thereto, said extension member is in a non-collapsible monolithic fixed structure, such that when said handle is positioned adjacent the guitar bridge in generally parallel relation thereto, said extension member is in generally perpendicular relation to the guitar bridge.

13. The ergonomic puller according to claim 7, wherein said handle includes a protrusion on one end configured and dimensioned with a ring aperture to accommodate a key ring.

14. An ergonomic apparatus for removing a bridge pin from a guitar bridge, which comprises:

a) a handle configured and dimensioned to accommodate a hand grip with thumb touching the index finger; and b) an extension member attached to said handle and movable between a first closed position in-line with said handle, and a second open position perpendicular to said handle, said extension member having a capture notch at its free end, said extension member including a recessed cavity directly adjacent said capture notch, said recessed cavity being configured and dimensioned with a beveled undersurface to receive and engage the undersurface of the bridge pin head in a manner to facilitate application of direct force thereof without the need for application of leverage on a surface as a backstop to remove the bridge pin from the guitar bridge, wherein said handle is formed as a housing with a groove to receive said extension member when in said closed position such that at least a portion of said extension member fits in said groove to form a generally ergonomic cylindrically shaped apparatus.

15. The ergonomic apparatus according to claim 14, wherein said extension member is of such dimension to avoid prying on the guitar bridge or causing surface damage to the adjacent areas or other guitar pins when pulling a particular guitar bridge pin.

16. The ergonomic apparatus according to claim 6, wherein:

a) said handle defines a cavity for reception of a coil spring;

b) a coil spring is positioned within said cavity; and c) a cam member is positioned between said coil spring and said extension member, wherein said coil spring alternatively compresses and extends under a load and causes said cam member to engage said extension member to facilitate locking said spring arm in one of said first closed position and said second open position, said extension member passing through an over-center position therebetween.

17. The ergonomic apparatus according to claim 14, wherein said capture notch is made of a material selected from one of metal, hard plastic, glass filled nylon, high density molecular weight polyethylene and other hard materials.

18. A method for pulling a bridge pin from a guitar bridge utilizing an ergonomic puller including:

a) a handle configured and dimensioned to accommodate a hand crush grip with thumb touching the index finger; and b) an extension member attached to said handle and having a capture notch at its free end, said capture notch being made of a material selected from one of metal, hard plastic, glass filled nylon, high density molecular weight polyethylene and other hard materials, said capture notch having a beveled surface for contact with the lower surface of the bridge pin, said extension member further including a recessed cavity directly adjacent said capture notch, said recessed cavity being configured and dimensioned to receive the head of the bridge pin so as to facilitate application of direct force thereto to remove the bridge pin from the guitar bridge, the method comprising the steps of:

c) gripping said handle with thumb touching the index finger;

d) positioning said capture notch of said extension member beneath the head of the bridge pin while positioning the head of the pin within said recessed cavity with optimal surface-to-surface contact between said beveled surface and the lower surface of the bridge pin; and e) applying direct force to remove the bridge pin from the guitar bridge without the need for application of leverage thereto.

19. The method according to claim 18, wherein said extension member is pivotably attached to said handle and is pivotably movable between a first closed position in line with said handle, and a second open position generally perpendicular to said handle, and said housing defines a groove dimensioned and positioned to receive said extension member when said extension member is in said closed position, such that at least a portion of said extension member fits in said groove to form a generally ergonomic cylindrically shaped device.

* * * * *